US010273832B2

(12) United States Patent
Cha et al.

(10) Patent No.: US 10,273,832 B2
(45) Date of Patent: Apr. 30, 2019

(54) SUPERCRITICAL CARBON DIOXIDE POWER GENERATION SYSTEM UTILIZING PLURAL HEAT SOURCES

(71) Applicant: DOOSAN HEAVY INDUSTRIES & CONSTRUCTION CO., LTD., Changwon-si, Gyeongsangnam-do (KR)

(72) Inventors: Song Hun Cha, Osan-si (KR); Hak Soo Kim, Yongin-si (KR); Sang Hyeun Kim, Yongin-si (KR); Jun Tae Jang, Seoul (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 164 days.

(21) Appl. No.: 15/407,448

(22) Filed: Jan. 17, 2017

(65) Prior Publication Data

US 2017/0204747 A1 Jul. 20, 2017

(30) Foreign Application Priority Data

Jan. 15, 2016 (KR) ..... 10-2016-0005501

(51) Int. Cl.
*F01K 25/10* (2006.01)
*F01K 23/12* (2006.01)
(Continued)

(52) U.S. Cl.
CPC ..... *F01K 25/103* (2013.01); *F01K 7/16* (2013.01); *F01K 7/32* (2013.01); *F01K 23/12* (2013.01)

(58) Field of Classification Search
CPC ..... F01K 25/103; F01K 23/12; F01K 7/16; F01K 7/32
(Continued)

(56) References Cited

U.S. PATENT DOCUMENTS 2,939,286 A * 6/1960 Pavlecka ..... F01K 19/02 122/1 R
9,341,084 B2 * 5/2016 Xie ..... F01K 7/32
(Continued)

FOREIGN PATENT DOCUMENTS

KR 10-2014-0064704 A 5/2014

OTHER PUBLICATIONS

Communication dated Dec. 18, 2017 from the Korean Intellectual Property Office in counterpart application No. 10-2016-0005501.

*Primary Examiner* — Hoang M Nguyen
(74) *Attorney, Agent, or Firm* — Invenstone Patent, LLC

(57) ABSTRACT

Disclosed herein is a supercritical carbon dioxide power generation system utilizing a plurality of heat sources, comprising: a pump for circulating a working fluid; a plurality of heat exchangers for heating the working fluid through an external heat source; a plurality of turbines driven by the working fluid heated through the heat exchangers; and a plurality of recuperators that allow the working fluid passed through the turbines and the working fluid passed through the pump to heat exchange with each other to cool the working fluid passed through the turbine, wherein the plurality of heat exchangers are sequentially disposed from a high temperature region at an inlet end into which waste heat gas stream is introduced up to a low temperature region at an outlet end through which the waste heat gas stream is discharged via a mediate temperature region.

13 Claims, 7 Drawing Sheets

(51) Int. Cl.
*F01K 7/16* (2006.01)
*F01K 7/32* (2006.01)

(58) Field of Classification Search
USPC ..... 60/651, 671
See application file for complete search history.

(56) References Cited

U.S. PATENT DOCUMENTS

| | | | | |
|---|---|---|---|---|
| 2002/0112479 | A1* | 8/2002 | Keefer | F02B 43/10 60/651 |
| 2012/0131918 | A1* | 5/2012 | Held | F01K 3/185 60/645 |
| 2014/0102101 | A1* | 4/2014 | Xie | F01K 25/103 60/647 |
| 2015/0076831 | A1 | 3/2015 | Giegel | |

* cited by examiner

【FIG. 1】
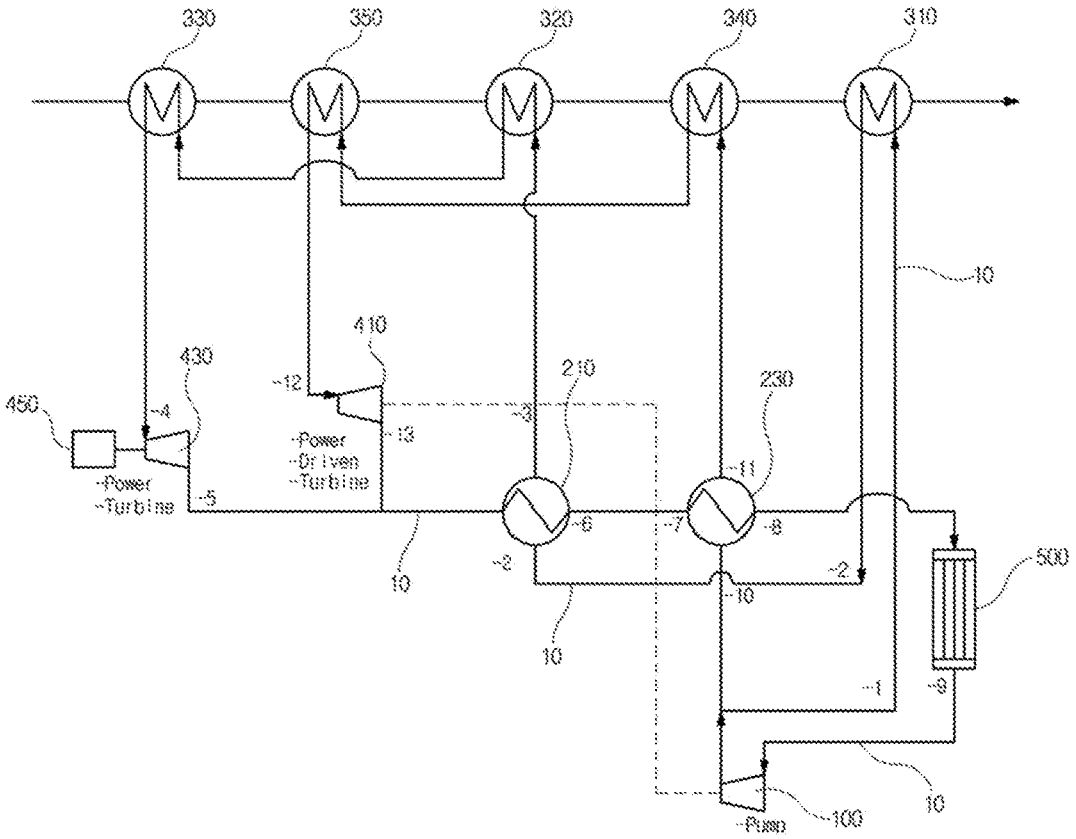

【FIG. 2】
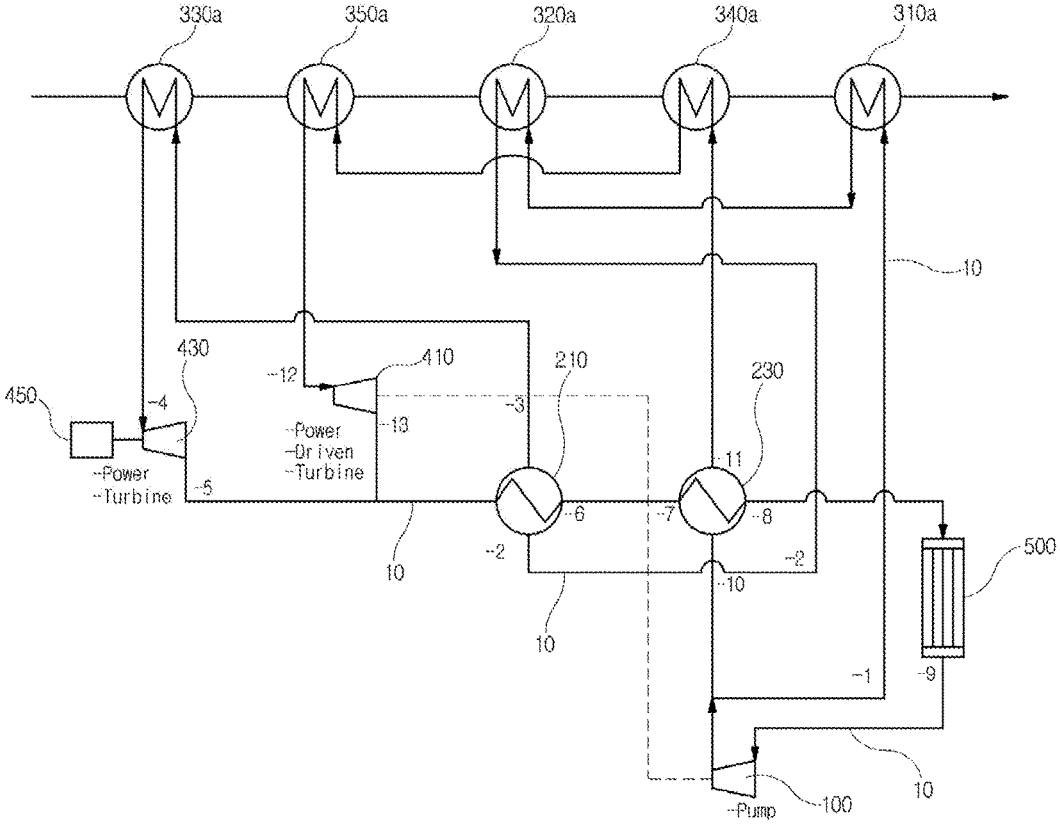

【FIG. 3】
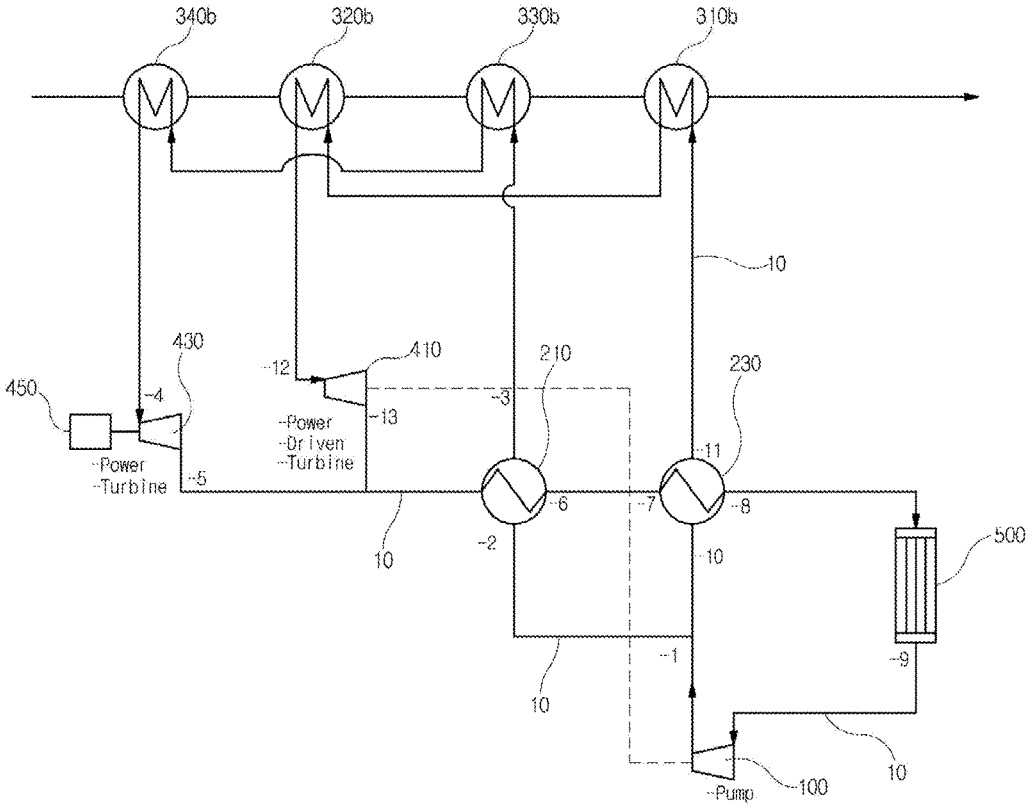

【FIG. 4】
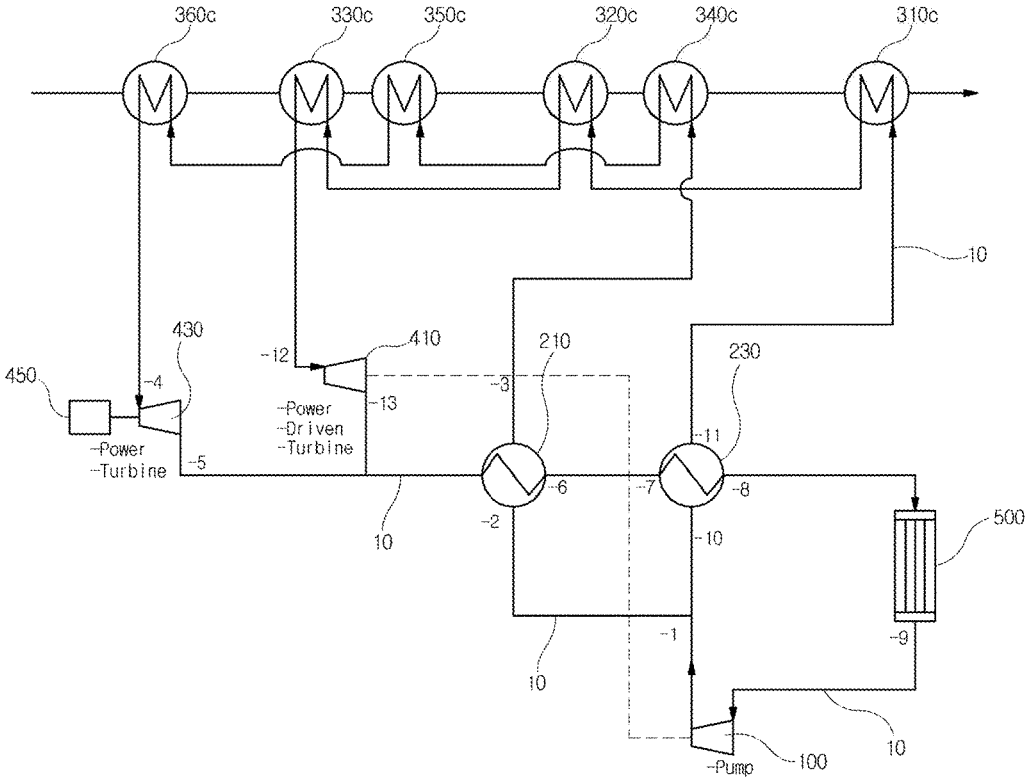

【FIG. 5】
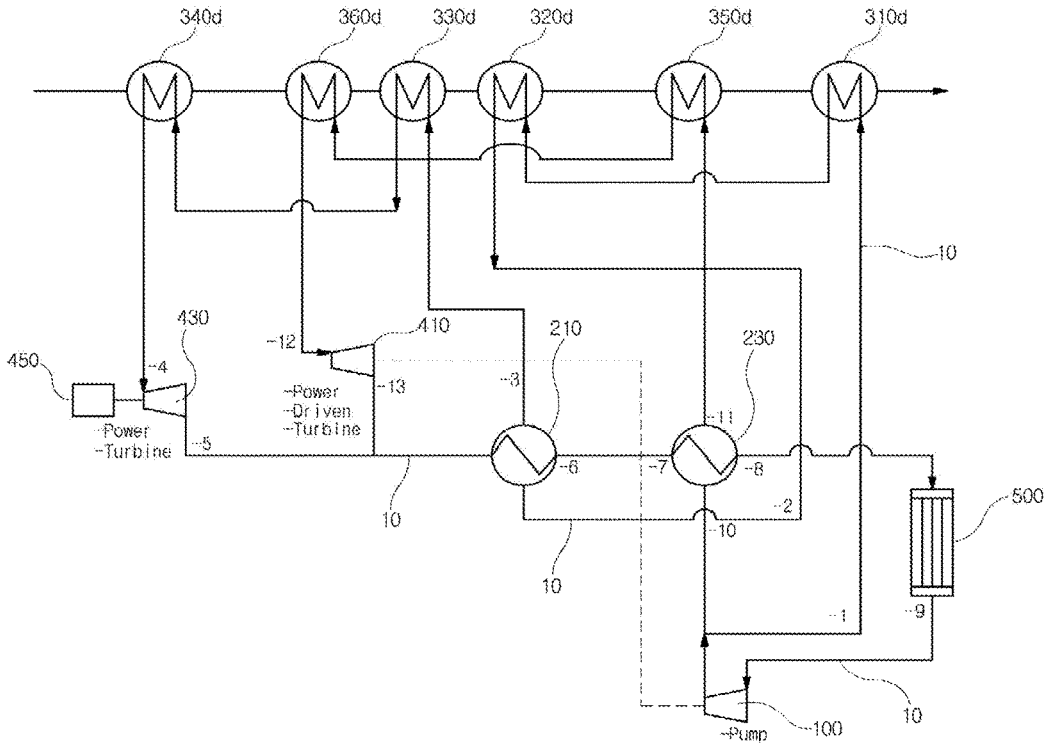

【FIG. 6】
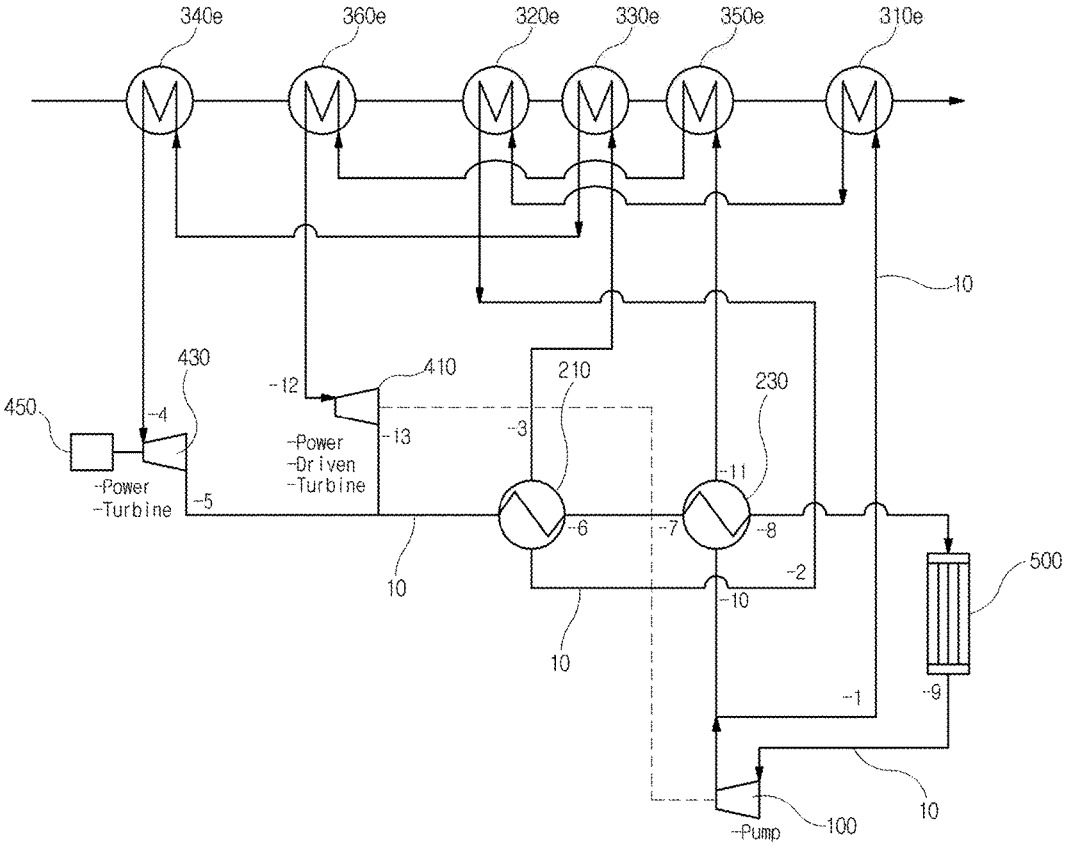

【FIG. 7】
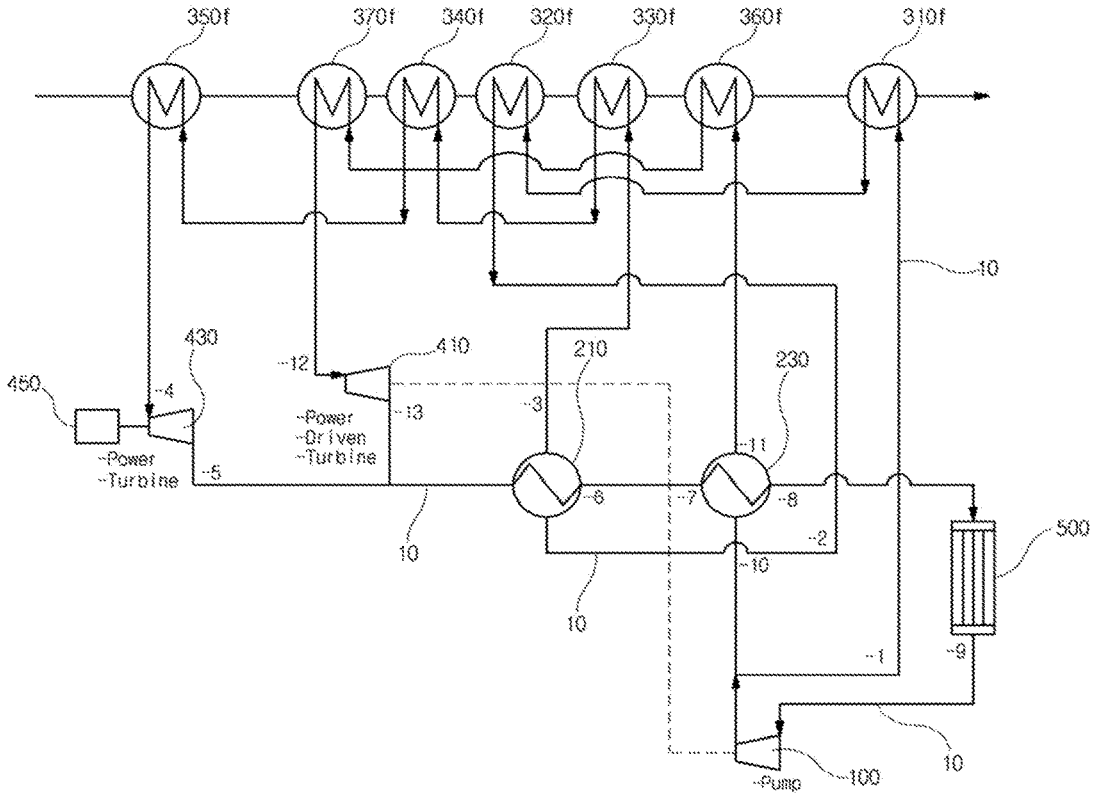

SUPERCRITICAL CARBON DIOXIDE POWER GENERATION SYSTEM UTILIZING PLURAL HEAT SOURCES

CROSS-REFERENCE TO RELATED APPLICATIONS

This application claims priority to Korean Patent Application No. 10-2016-0005501, filed on Jan. 15, 2016, the disclosure of which is incorporated herein by reference in its entirety.

BACKGROUND OF THE INVENTION

Field of the Invention

Exemplary embodiments of the present invention relate to a supercritical carbon dioxide power generation system utilizing plural heat sources, and more particularly, to a supercritical carbon dioxide power generation system utilizing plural heat sources, in which the plural heat sources that are used in recovering waste heat and exchanging heat are disposed efficiently to enhance performance of the system.

Description of the Related Art

As a necessity to efficiently generate electricity is increasing more and more and a movement to reduce pollutant emissions is being activated more and more over the world, various attempts to increase electricity output while reducing the pollutant emissions have been conducted. As one of the attempts, research and development into power generation systems using supercritical carbon dioxide as a working fluid as disclosed in Japanese Patent Laid-Open Publication No. 2012-145092 has been actively conducted.

The supercritical carbon dioxide has density similar to a liquid state and at the same time viscosity similar to gas so that appliances thereof can be miniaturized and power consumption required to compress and circulate a working fluid can be minimized. In addition, the supercritical carbon dioxide has an advantage in that it can be handled easily because its critical point that occurs at 31.4° C. and 72.8 atmospheres is much lower than a critical point of water that occurs at 373.95° C. and 217.7 atmospheres. When a plurality of heat sources having a constraint on the heat sources are applied, configuration of the system is complicated and it is difficult to effectively use heat. Therefore, conventional supercritical carbon dioxide power generation systems have generally one heater as a heat source. Accordingly, there are problems in that configuration of the system is limited and it is difficult to use the heat source effectively.

PRIOR ART DOCUMENTS

[Patent Document 1] Japanese Patent Laid-Open Publication No. 2012-145092 (published on Aug. 2, 2012)

SUMMARY OF THE INVENTION

An object of the present invention is to provide a supercritical carbon dioxide power generation system utilizing plural heat sources, in which the plural heat sources that are used in recovering waste heat and exchanging heat are disposed efficiently to enhance performance of the system.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with one aspect of the present invention, a supercritical carbon dioxide power generation system utilizing a plurality of heat sources comprises: a pump for circulating a working fluid; a plurality of heat exchangers for heating the working fluid through an external heat source; a plurality of turbines driven by the working fluid heated through the heat exchangers; and a plurality of recuperators that allow the working fluid passed through the turbines and the working fluid passed through the pump to heat exchange with each other to cool the working fluid passed through the turbine, wherein the plurality of heat exchangers are sequentially disposed from a high temperature region at an inlet end into which waste heat gas stream is introduced up to a low temperature region at an outlet end through which the waste heat gas stream is discharged via a mediate temperature region.

The supercritical carbon dioxide power generation system further comprises a control valve for selectively supplying the working fluid to any one of the plurality of heat exchangers in response to the temperature of the working fluid passed through the pump.

The heat exchanger comprises a first heat exchanger disposed in the low temperature region; a fourth heat exchanger disposed in the mediate temperature region; and second, third and fifth heat exchangers disposed in the high temperature region.

The third, fifth and second heat exchangers are disposed sequentially in the high temperature region in a direction toward the mediate temperature region.

The working fluid is transferred to the first heat exchanger when the temperature of the working fluid passed through the pump is equal to or lower than a reference temperature, whereas the working fluid is transferred to the fourth heat exchanger when the temperature of the working fluid exceeds the reference temperature.

The recuperator comprises a first recuperator disposed between a rear end of the turbine and a front end of the pump and a second recuperator disposed between a rear end of the first recuperator and the front end of the pump.

There is heat transfer between the working fluid of which temperature is equal to or lower than the reference temperature and the waste heat gas stream in the first heat exchanger to be heated, and the working fluid is thereafter transferred to the first recuperator and absorbs heat from the working fluid passed through the turbine, and then transferred to the second heat exchanger and there is heat transfer with the waste heat gas stream to be heated, while the working fluid passed through the second heat exchanger is transferred to the third heat exchanger and there is heat transfer with the waste heat gas stream to be heated, and thereafter transferred to any one of the turbines.

The working fluid of which temperature exceeds the reference temperature is transferred to the second recuperator and absorbs heat from the working fluid passed through the first recuperator, and thereafter transferred to the fourth heat exchanger and there is heat transfer with the waste heat gas stream to be heated, while the working fluid passed through the fourth heat exchanger is transferred to the fifth heat exchanger and there is heat transfer with the waste heat gas stream to be heated, and thereafter transferred to the other of the turbines.

The turbine comprises a high-pressure turbine driven by the working fluid supplied from any one of the third and fifth heat exchangers and a low-pressure turbine driven by the working fluid supplied from the other of the third and fifth heat exchangers.

The high-pressure turbine is connected to the third heat exchanger while the low-pressure turbine is connected to the fifth heat exchanger.

The supercritical carbon dioxide power generation system utilizing plural heat sources according to an embodiment of the present invention is capable of enhancing performance of the system by efficiently disposing a plurality of heat sources that are used in recovering waste heat and exchanging heat.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a block diagram illustrating a supercritical carbon dioxide power generation system according to a first embodiment of the present invention;

FIG. 2 is a block diagram illustrating a supercritical carbon dioxide power generation system according to a second embodiment of the present invention;

FIG. 3 is a block diagram illustrating a supercritical carbon dioxide power generation system according to a third embodiment of the present invention;

FIG. 4 is a block diagram illustrating a supercritical carbon dioxide power generation system according to a fourth embodiment of the present invention;

FIG. 5 is a block diagram illustrating a supercritical carbon dioxide power generation system according to a fifth embodiment of the present invention;

FIG. 6 is a block diagram illustrating a supercritical carbon dioxide power generation system according to a sixth embodiment of the present invention; and FIG. 7 is a block diagram illustrating a supercritical carbon dioxide power generation system according to a seventh embodiment of the present invention.

DESCRIPTION OF SPECIFIC EMBODIMENTS

Hereinafter, a supercritical carbon dioxide power generation system utilizing plural heat sources according to an exemplary embodiment of the present invention will be described in detail with reference to the accompanying drawings.

Generally, the supercritical carbon dioxide power generation system configures a close cycle in which carbon dioxide used for power generation is not emitted to the outside and uses supercritical carbon dioxide as a working fluid.

The supercritical carbon dioxide power generation system uses the supercritical carbon dioxide as the working fluid and therefore can use exhaust gas emitted from a thermal power plant and the like so that it can be used not only in a single power generation system but also in a hybrid power generation system in combination with a thermal power generation system. Either carbon dioxide separated from the exhaust gas or separate carbon dioxide may be supplied as the working fluid in the supercritical carbon dioxide power generation system.

The supercritical carbon dioxide within a cycle (hereinafter, the "working fluid") passes through a compressor and then is heated while passing through a heat source such as a heater, with the result it becomes a high temperature and high pressure working fluid and drives a turbine. The turbine is connected to an electric generator or a pump wherein the electric generator connected to the turbine generates electricity and the turbine drives the pump connected to the turbine. The working fluid passed through the turbine is cooled while passing through a heat exchanger and the cooled working fluid is again supplied to the compressor, thereby completing the circulation in the cycle. The turbine or the heat exchanger may be provided in plural.

The present invention is to provide a supercritical carbon dioxide power generation system, in which a plurality of heaters utilizing waste heat gas as a heat source are provided and the plurality of heaters are distributed appropriately depending on the temperature of the working fluid circulating within the cycle so that the working fluid circulates within the cycle, thereby enhancing performance of the system.

The supercritical carbon dioxide power generation system according to various embodiments of the present invention is used as a meaning including a system that all the working fluids flowing within a cycle are in a supercritical state as well as a system that most of the working fluids are in the supercritical state and the remains are in a subcritical state.

Further, carbon dioxide is used as the working fluid in various embodiments of the present invention, wherein the term "carbon dioxide" is used as a meaning including pure carbon dioxide in terms of a chemical meaning, carbon dioxide including somewhat impurities in general terms and even a fluid in which more than one fluid as additives is mixed with the carbon dioxide.

FIG. 1 shows a block diagram illustrating a supercritical carbon dioxide power generation system according to an embodiment of the present invention.

As shown in FIG. 1, the supercritical carbon dioxide power generation system according to an embodiment of the present invention uses carbon dioxide as a working fluid and comprises a pump 100 for circulating the working fluid, a plurality of recuperators and heat sources for heat exchanging with the working fluid passed through the pump 100, a plurality of turbines 410, 430 driven by the working fluid heated while passing through the recuperators and heat sources, a generator 450 driven by the turbines 410 and 430 and a cooler 500 for cooling the working fluid flowing into the pump 100.

Each of the components in the present invention is connected to each other by a transfer pipe 10 through which the working fluid flows. It is to be understood that the working fluid flows along the transfer pipe 10, unless specifically mentioned. However, when a plurality of components are integrated, there may be parts or regions actually serving as the transfer pipe 10 within the integrated components. Even in this case, it is natural to be understood that the working fluid flows along the transfer pipe 10. A channel performing a separate function will be described additionally.

Further, since temperatures of the working fluid described herein are used to describe an example in a case of several cases, they should not be understood as meaning absolute temperature values.

The pump 100 is driven by a low-pressure turbine 410 to be described later (see a dotted line in FIG. 1) and serves to transfer the low temperature working fluid cooled through the cooler 500 to a recuperator or a heat source. It is preferable that a three-way valve is provided at a rear end of the pump 100 to select a circulating flow path of the working fluid.

In the recuperator, there is heat transfer with the working fluid that is cooled from a high temperature to a mediate temperature while passing through the turbines 410, 430 and expanding, thereby primarily cooling the working fluid. The cooled working fluid is transferred to the cooler 500 and cooled secondarily, and then transferred to the pump 100. There is heat transfer between the working fluid transferred to the recuperator through the pump 100 and the working fluid passed through the turbines 410 and 430 to be heated primarily, and then the working fluid is supplied to a heat source as described later. In this embodiment, an example in which two recuperators 210 and 230 are provided is described.

A first recuperator 210 is provided at a position before an inlet end through which the working fluid flows into a second heat exchanger 310 as described later, while a second recuperator 230 is provided at a position before an inlet end through which the working fluid flows into a fourth heat exchanger 330 as described later.

Flow rate mt0 which is the sum of flow rate mt1 of the fluid passed through the high-pressure turbine 430 and flow rate mt2 of the fluid passed through the low-pressure turbine 410 (hereinafter, the "combined flow rate") flows into the first recuperator 210 via two branches. Further, the combined flow rate mt0 passing through the first recuperator 210 again flows into the second recirculator 230. The working fluid cooled while passing through the first recuperator 210 and the second recuperator 230 sequentially flows into the cooler 500 and is cooled, and then it is supplied to the pump 100 again.

Meanwhile, a plurality of heat sources may be provided as necessary. In this embodiment, an example in which the heat sources are provided as first to fifth heat exchangers 310 to 350 respectively is described. The first to fifth heat exchangers 310 to 350 use gas stream having waste heat (hereinafter, the "waste heat gas stream") such as exhaust gas discharged from a boiler of a power plant as a heat source, which is a heat source that does not have any extra emission regulation condition when discharging waste heat gas.

The first to fifth heat exchangers 310 to 350 serve to allow the waste heat gas stream and the working fluid circulating in the cycle to heat exchange, i.e., to have heat transfer, with each other and heat the working fluid with heat supplied from the waste heat gas stream.

In addition, the first to fifth heat exchangers 310 to 350 can be relatively divided into a low temperature, a mediate temperature and a high temperature depending on the temperature of the waste heat gas stream. In other words, as the heat exchanger is closer to the inlet end into which the waste heat gas stream is introduced, it can perform heat exchange at a higher temperature, while as the heat exchanger is closer to the outlet end through which the waste heat gas stream is discharged, it can perform heat exchange at a lower temperature.

In this embodiment, an example in which the first heat exchanger 310 is in a relatively low temperature compared to other heat exchangers, the fourth heat exchanger 340 is in a relatively mediate temperature, and the second, third and fifth heat exchangers 320, 330, 350 are in a relatively high temperature is described. More specifically, an example in which the third heat exchanger 330, the fifth heat exchanger 350, the second heat exchanger 320, the fourth heat exchanger 340 and the first heat exchanger 310 are disposed sequentially in a direction from the inlet end into which the waste heat gas stream to the outlet end is described.

The low temperature working fluid cooled while passing through the pump 100 is transferred first to the first heat exchanger 310 before being transferred to the first recuperator 210 and there is heat transfer with the waste heat gas stream, and the working fluid is primarily heated. The working fluid passed through the first heat exchanger 310 passes through the first recuperator 210 and there is heat transfer with the working fluid discharged from the turbines 410 and 430, and the working fluid is heated once again. The mediate temperature working fluid heated as above is transferred to the second heat exchanger 320 and there is heat transfer once again with the waste heat gas stream and is heated. Thereafter, the working fluid is transferred to the third heat exchanger 330 and further heated through heat transfer with the waste heat gas stream to be in a high temperature, and then the working fluid is supplied to the high-pressure turbine 430.

The working fluid passed through the high-pressure turbine 430 is cooled while passing through the first recuperator 210 and the second recuperator 230 sequentially and transferred to the pump 100 again via the cooler 500.

If the temperature of the working fluid discharged from the pump 100 is higher than the temperature of the working fluid supplied to the first heat exchanger 310, the working fluid is transferred directly to the second recuperator 230 instead of the first heat exchanger 310. In this case, the reason why the working fluid is transferred to the second recuperator 230 is that even if the working fluid does not pass through the first heat exchanger 310, the working fluid can be sufficiently heated in the second recuperator 230. There is heat transfer between the working fluid passed through the pump 100 and the working fluid passed through the first recuperator 210 and the working fluid is introduced into the second recuperator 230, and is heated primarily. Thereafter, there is heat transfer between the working fluid and the waste heat gas stream in the fourth heat exchanger 340 to be heated secondarily, and then the working fluid is heated thirdly in the fifth heat exchanger 350 and transferred to the low-pressure turbine 410.

Turbines 410 and 430 are composed of a low-pressure turbine 410 and a high-pressure turbine 430 and driven by the working fluid to drive a generator 450 connected to at least one of the turbines so that they serve to generate electric power. The working fluid is expanded while passing through the low-pressure turbine 410 and the high-pressure turbine 430 so that the turbines 410 and 430 also serve as an expander. In this embodiment, the generator 450 is connected to the high-pressure turbine 430 to generate electric power and the low-pressure turbine 410 serves to drive the pump 100.

The terms, high-pressure turbine 430 and low-pressure turbine 410 used herein are terms having relative meaning. Therefore, it should not be understood as meaning a high pressure if pressure is higher than a specific pressure taken as a reference value and as meaning a low pressure if the pressure is lower than the specific pressure.

Hereinafter, change in temperature depending on flow of the working fluid in the supercritical carbon dioxide power generation system according to an embodiment of the present invention, which has the configuration as described above, will be described with reference to specific examples.

First, when the working fluid discharged from the pump 100 is in a low temperature of 30° C. to 40° C., it is transferred to the first heat exchanger 310 in the low temperature region. There is a heat transfer between the working fluid and the waste heat gas stream in the first heat exchanger 310 and the working fluid is transferred to the first recuperator 210 in a state of having been heated to 70° C. to 80° C.

The working fluid passed through the first heat exchanger 310 absorbs heat of the working fluid passed through the turbines 410 and 430 from the first recuperator 210 and is heated up to about 200° C. Thereafter, the working fluid is transferred to the second heat exchanger 320 in the high temperature region to have heat transfer with the waste heat gas stream, and heated to 250° C.

The working fluid heated in the second heat exchanger 320 is again transferred to the third heat exchanger 330 and heated to 300° C. to 400° C., and then it is transferred to the high-pressure turbine 430 to drive the high-pressure turbine 430.

If the working fluid is transferred from the beginning to the heat exchanger in the high temperature region in order to heat the working fluid sufficient to drive the high-pressure turbine 430, a large amount of heat is required until the low temperature working fluid reaches a target temperature and efficiency of the system is lowered. Accordingly, in the present invention, it is configured such that the working fluid is heated first in the first heat exchanger 310 in the low temperature region and then passes through the second heat exchanger 320 and the third heat exchanger 330 in the high temperature region sequentially so that the working fluid is heated efficiently.

On the other hand, if the working fluid discharged from the pump 100 is in a temperature exceeding 40° C., the working fluid discharged through the pump 100 is preferably transferred to the fourth heat exchanger 340 in the mediate temperature region (In this regard, description has been made with reference to an example in which if the temperature of the working fluid is equal to or lower than a reference temperature that is specified as 40° C., it is transferred to the first heat exchanger, whereas if the temperature of the working fluid exceeds the reference temperature, it is transferred to the fourth heat exchanger. However, the reference temperature may vary depending on setup of the system).

The working fluid passed through the pump 100 absorbs heat from the working fluid passed through the first recuperator 210 from the second recuperator 230 via the turbines 410 and 430 and can be heated to a medium temperature of 70° C. to 80° C.

There is heat transfer between the working fluid passed through the second recuperator 230 and the waste heat gas stream in the fourth heat exchanger 340 and the working fluid is heated up to about 150° C. Thereafter, the working fluid is transferred to the fifth heat exchanger 350 in the high temperature region and heated up to 300° C., and then it is transferred to the low-pressure turbine 410 to drive the low-pressure turbine 410.

As described above, the heat exchanger in the high temperature region is divided into two bundles (one bundle of the second and third heat exchangers and the other bundle of the fifth heat exchanger) and the heat exchanger in the high temperature region is used to make a high temperature working fluid (which heats the working fluid passed through the first heat exchanger and the first recuperator). The heat exchanger in the low temperature region (i.e., first heat exchanger) is used to heat the low temperature working fluid passed through the cooler and the pump. Further, a heat source in the mediate temperature region (i.e., fourth heat exchanger) is used to heat the mediate temperature working fluid passed through the pump and the recuperator.

In this way, it is possible to make heat exchange in the power generation system efficient and enhance performance of the system by appropriately disposing the heat exchangers depending on the temperature of their respective working fluid.

The supercritical carbon dioxide power generation system of the present invention, which has the configuration as described above, can be configured variously depending on the number of heat exchangers and how to arrange the heat exchangers according to temperature regions of the waste heat. Hereinafter, supercritical carbon dioxide power generation systems according to various embodiments of the present invention will be described (for the sake of convenience of description, the same components and functions as those of the first embodiment will not be described in detail).

FIG. 2 shows a block diagram illustrating a supercritical carbon dioxide power generation system according to a second embodiment of the present invention. As shown in FIG. 2, the second embodiment of the present invention may also comprise first to fifth heat exchangers.

In the second embodiment, the first heat exchanger 310*a* is disposed in a relatively low temperature region compared to other heat exchangers, the second, third and fifth heat exchangers 320*a*, 330*a*, 350*a* are disposed in a relatively high temperature region, and the fourth heat exchanger 340*a* is disposed in a relatively mediate temperature region. In this case, the third heat exchanger 330*a*, the fifth heat exchanger 350*a*, the second heat exchanger 320*a*, the fourth heat exchanger 340*a* and the first heat exchanger 310*a* are disposed sequentially in a direction from the inlet end into which the waste heat gas stream to the outlet end.

The low temperature working fluid passed through the pump 100 is transferred to the first heat exchanger 310*a* and there is heat transfer with the waste heat gas stream and is primarily heated, and then it is transferred to the second heat exchanger 320*a* and there is heat transfer with the waste heat gas stream once again and is heated. Then, the working fluid is transferred to the first recuperator 210 and there is heat transfer with the working fluid passed through the high-pressure turbine 430 and the low-pressure turbine 410 as described later, and then it is transferred to the third heat exchanger 330*a*. The working fluid is further heated through heat transfer with the waste heat gas stream in the third heat exchanger 330*a* to be a fluid of high temperature and high pressure, and then it is supplied to the high-pressure turbine 430 to drive the high-pressure turbine 430.

The working fluid passed through the high-pressure turbine 430 is cooled while passing through the first recuperator 210 and the second recuperator 230 sequentially and transferred to the pump 100 again via the cooler 500.

If the temperature of the working fluid discharged from the pump 100 is higher than the temperature of the working fluid supplied to the first heat exchanger 310*a*, the working fluid is transferred directly to the second recuperator 230 instead of the first heat exchanger 310*a*. In this case, the reason why the working fluid is transferred to the second recuperator 230 is that even if the working fluid does not pass through the first heat exchanger 310*a*, the working fluid can be sufficiently heated in the second recuperator 230. There is heat transfer between the working fluid passed through the pump 100 and the working fluid passed through the first recuperator 210 and the working fluid is introduced into the second recuperator 230, and is heated primarily. Thereafter, there is heat transfer between the working fluid and the waste heat gas stream in the fourth heat exchanger 340*a* to be heated secondarily, and then the working fluid is heated thirdly in the fifth heat exchanger 350*a* and transferred to the low-pressure turbine 410.

The working fluid passed through the low-pressure turbine 410 is cooled while passing through the first recuperator 210 and the second recuperator 230 sequentially and transferred to the pump 100 again via the cooler 500.

FIG. 3 shows a block diagram illustrating a supercritical carbon dioxide power generation system according to a third embodiment of the present invention. As shown in FIG. 3, this embodiment may comprise first to fourth heat exchangers.

In the third embodiment, the first heat exchanger 310*b* is disposed in a relatively low temperature region compared to other heat exchangers, the second and fifth heat exchangers 320*b*, 340*b* are disposed in a relatively high temperature region, and the third heat exchanger 330*b* is disposed in a relatively mediate temperature region. In this case, the fourth heat exchanger 340*b*, the second heat exchanger 320*b*, the third heat exchanger 330*b* and the first heat exchanger 310*b* are disposed sequentially in a direction from the inlet end into which the waste heat gas stream to the outlet end.

Unlike the embodiments as described above, it may be configured such that the low temperature working fluid passed through the pump 100 is transferred to the first recuperator 210 and heat exchanged with the working fluid passes through the high-pressure turbine 430 and the low-pressure turbine 410 as described later to recover heat. This configuration corresponds to a case in which the temperature of the working fluid discharged from the pump 100 is very low and therefore some more heat is required.

Then, the working fluid' is transferred to the third heat exchanger 330*b* and there is heat transfer with the waste heat gas stream and is primarily heated, and then it is transferred to the fourth heat exchanger 340*b* and there is heat transfer with the waste heat gas stream once again and is heated. The working fluid is then supplied to the high-pressure turbine 430 to drive the high-pressure turbine 430. The working fluid passed through the high-pressure turbine 430 is cooled while passing through the first recuperator 210 and the second recuperator 230 sequentially and transferred to the pump 100 again via the cooler 500.

If the temperature of the working fluid discharged from the pump 100 is higher than that of the working fluid supplied to the first recuperator 210, there is heat transfer between the working fluid passed through the pump 100 and the working fluid passed through the first recuperator 210 and the working fluid is introduced into the second recuperator 230, and is heated primarily. Thereafter, there is heat transfer between the working fluid and the waste heat gas stream in the first heat exchanger 310*b* to be heated secondarily, and then the working fluid is heated thirdly in the second heat exchanger 320*b* and transferred to the low-pressure turbine 410.

The working fluid passed through the low-pressure turbine 410 is cooled while passing through the first recuperator 210 and the second recuperator 230 sequentially and transferred to the pump 100 again via the cooler 500.

FIG. 4 shows a block diagram illustrating a supercritical carbon dioxide power generation system according to a fourth embodiment of the present invention. As shown in FIG. 4, this embodiment may comprise first to sixth heat exchangers.

In the fourth embodiment, the first heat exchanger 310*c* is disposed in a relatively low temperature region compared to other heat exchangers, the third and sixth heat exchangers 330*c*, 360*c* are disposed in a relatively high temperature region, and the second, fourth and fifth heat exchangers 320*c*, 340*c*, 350*c* are disposed in a relatively mediate temperature region. In this case, the sixth heat exchanger 360*c*, the third heat exchanger 330*c*, the fifth heat exchanger 350*c*, the second heat exchanger 320*c*, the fourth heat exchanger 340*c* and the first heat exchanger 310*c* are disposed sequentially in a direction from the inlet end into which the waste heat gas stream to the outlet end.

It may be configured such that the low temperature working fluid passed through the pump 100 is transferred to the first recuperator 210 and there is heat transfer with the working fluid passes through the high-pressure turbine 430 and the low-pressure turbine 410 as described later to recover heat. This configuration corresponds to a case in which the temperature of the working fluid discharged from the pump 100 is very low and therefore more heat is required.

Then, the working fluid is transferred to the fourth heat exchanger 340*c* and there is heat transfer between the working fluid and the waste heat gas stream to be heated secondarily, and then the working fluid passes through the fifth heat exchanger 350*c* and the sixth heat exchanger 360*c* sequentially and there is heat transfer between the working fluid and the waste heat gas stream to be heated thirdly and fourthly. The working fluid is then supplied to the high-pressure turbine 430 to drive the high-pressure turbine 430. The working fluid passed through the high-pressure turbine 430 is cooled while passing through the first recuperator 210 and the second recuperator 230 sequentially and transferred to the pump 100 again via the cooler 500.

If the temperature of the working fluid discharged from the pump 100 is higher than that of the working fluid supplied to the first recuperator 210, there is heat transfer between the working fluid passed through the pump 100 and the working fluid passed through the first recuperator 210 and the working fluid is introduced into the second recuperator 230, and is heated primarily. Thereafter, there is heat transfer between the working fluid and the waste heat gas stream in the first heat exchanger 310*c* to be heated secondarily, and then the working fluid is heated while passing through the second heat exchanger 320*c* and the third heat exchanger 330*c* sequentially and transferred to the low-pressure turbine 410.

The working fluid passed through the low-pressure turbine 410 is cooled while passing through the first recuperator 210 and the second recuperator 230 sequentially and transferred to the pump 100 again via the cooler 500.

FIG. 5 shows a block diagram illustrating a supercritical carbon dioxide power generation system according to a fifth embodiment of the present invention. As shown in FIG. 5, this embodiment may comprise first to sixth heat exchangers.

In the fifth embodiment, the first heat exchanger 310*d* is disposed in a relatively low temperature region compared to other heat exchangers, the fourth and sixth heat exchangers 340*d*, 360*d* are disposed in a relatively high temperature region, and the second, third and fifth heat exchangers 320*d*, 330*d*, 350*d* are disposed in a relatively mediate temperature region. In this case, the fourth heat exchanger 340*d*, the sixth heat exchanger 360*d*, the third heat exchanger 330*d*, the second heat exchanger 320*d*, the fifth heat exchanger 350*d* and the first heat exchanger 310*d* are disposed sequentially in a direction from the inlet end into which the waste heat gas stream to the outlet end.

The low temperature working fluid passed through the pump 100 is transferred to the first heat exchanger 310*d* and heat exchanged with the waste heat gas stream to be heated primarily, and then it is transferred to the second heat exchanger 320*d* and there is heat transfer with the waste heat gas stream once again and is heated. Then, the working fluid is transferred to the first recuperator 210 and there is heat transfer with the working fluid passed through the high-pressure turbine 430 and the low-pressure turbine 410 as described later, and then it is transferred to the third heat exchanger 330*d*. The working fluid passed through the third heat exchanger 330*d* passes through the fourth heat exchanger 340*d*. There is heat transfer between the working fluid is heat exchanged and the waste heat gas stream while passing through the third heat exchanger 330*d* and the fourth heat exchanger 340*d* sequentially and hence further heated to be a fluid of high temperature and high pressure, and then the working fluid is supplied to the high-pressure turbine 430 to drive the high-pressure turbine 430.

The working fluid passed through the high-pressure turbine 430 is cooled while passing through the first recuperator 210 and the second recuperator 230 sequentially and transferred to the pump 100 again via the cooler 500.

If the temperature of the working fluid discharged from the pump 100 is higher than the temperature of the working fluid supplied to the first heat exchanger 310*d*, the working fluid is transferred directly to the second recuperator 230 instead of the first heat exchanger 310*d*. In this case, the reason why the working fluid is transferred to the second recuperator 230 is that even if the working fluid does not pass through the first heat exchanger 310*d*, the working fluid can be sufficiently heated in the second recuperator 230. There is heat transfer between the working fluid passed through the pump 100 and with the working fluid passed through the first recuperator 210 and the working fluid is introduced into the second recuperator 230, and is heated primarily. Thereafter, there is heat transfer between the working fluid and the waste heat gas stream in the fifth heat exchanger 350*d* to be heated secondarily, and then the working fluid is heated thirdly in the sixth heat exchanger 360*d* and transferred to the low-pressure turbine 410.

The working fluid passed through the low-pressure turbine 410 is cooled while passing through the first recuperator 210 and the second recuperator 230 sequentially and transferred to the pump 100 again via the cooler 500.

FIG. 6 shows a block diagram illustrating a supercritical carbon dioxide power generation system according to a sixth embodiment of the present invention. As shown in FIG. 6, this embodiment may comprise first to sixth heat exchangers.

In the sixth embodiment, the first heat exchanger 310*e* is disposed in a relatively low temperature region compared to other heat exchangers, the fourth and sixth heat exchangers 340*e*, 360*e* are disposed in a relatively high temperature region, and the second, third and fifth heat exchangers 320*e*, 330*e*, 350*e* are disposed in a relatively mediate temperature region. In this case, the fourth heat exchanger 340*e*, the sixth heat exchanger 360*e*, the second heat exchanger 320*e*, the third heat exchanger 330*e*, the fifth heat exchanger 350*e* and the first heat exchanger 310*e* are disposed sequentially in a direction from the inlet end into which the waste heat gas stream to the outlet end.

The low temperature working fluid passed through the pump 100 is transferred to the first heat exchanger 310*e* and heat exchanged with the waste heat gas stream to be heated primarily, and then it is transferred to the second heat exchanger 320*e* and there is heat transfer with the waste heat gas stream once again and is heated. Then, the working fluid is transferred to the first recuperator 210 and there is heat transfer with the working fluid passed through the high-pressure turbine 430 and the low-pressure turbine 410 as described later, and then it is transferred to the third heat exchanger 330*e*. In this case, the third heat exchanger 330*e* is disposed in a mediate temperature region between the second heat exchanger 320*e* and the fifth heat exchanger 350*e*. There is heat transfer between working fluid passed through the third heat exchanger 330*e* and the waste heat gas stream while passing through the fourth heat exchanger 340*e* and hence further heated to be a fluid of high temperature and high pressure, and then the working fluid is supplied to the high-pressure turbine 430 to drive the high-pressure turbine 430.

The working fluid passed through the high-pressure turbine 430 is cooled while passing through the first recuperator 210 and the second recuperator 230 sequentially and transferred to the pump 100 again via the cooler 500.

If the temperature of the working fluid discharged from the pump 100 is higher than the temperature of the working fluid supplied to the first heat exchanger 310*e*, the working fluid is transferred directly to the second recuperator 230 instead of the first heat exchanger 310*e*. In this case, the reason why the working fluid is transferred to the second recuperator 230 is that even if the working fluid does not pass through the first heat exchanger 310*e*, the working fluid can be sufficiently heated in the second recuperator 230. There is heat transfer between the working fluid passed through the pump 100 and the working fluid passed through the first recuperator 210 and the working fluid is introduced into the second recuperator 230, and is heated primarily. Thereafter, there is heat transfer between the working fluid and the waste heat gas stream in the fifth heat exchanger 350*e* to be heated secondarily, and then the working fluid is heated thirdly in the sixth heat exchanger 360*d* disposed in the high temperature region and transferred to the low-pressure turbine 410.

The working fluid passed through the low-pressure turbine 410 is cooled while passing through the first recuperator 210 and the second recuperator 230 sequentially and transferred to the pump 100 again via the cooler 500.

FIG. 7 shows a block diagram illustrating a supercritical carbon dioxide power generation system according to a seventh embodiment of the present invention. As shown in FIG. 7, this embodiment may comprise first to seventh heat exchangers.

In the seventh embodiment, the first heat exchanger 310*f* is disposed in a relatively low temperature region compared to other heat exchangers, the fifth and seventh heat exchangers 350*f*, 370*f* are disposed in a relatively high temperature region, and the second, third, fourth and sixth heat exchangers 320*f*, 330*f*, 340*f*, 360*f* are disposed in a relatively mediate temperature region.

In this case, the fifth heat exchanger 350*f*, the seventh heat exchanger 370*f*, the fourth heat exchanger 340*f*, the second heat exchanger 320*f*, the third heat exchanger 330*f*, the sixth heat exchanger 360*f* and the first heat exchanger 310*f* are disposed sequentially in a direction from the inlet end into which the waste heat gas stream to the outlet end.

The low temperature working fluid passed through the pump 100 is transferred to the first heat exchanger 310*f* and there is heat transfer with the waste heat gas stream to be heated primarily, and then it is transferred to the second heat exchanger 320*f* and there is heat transfer with the waste heat gas stream once again and is heated. Then, the working fluid is transferred to the first recuperator 210 and there is heat transfer with the working fluid passed through the high-pressure turbine 430 and the low-pressure turbine 410 as described later, and then it is transferred to the third heat exchanger 330*f*. In this case, the third heat exchanger 330*f* is disposed in a mediate temperature region between the second heat exchanger 320*f* and the sixth heat exchanger 360*f*. The working fluid passed through the third heat exchanger 330*f* passes through the fourth heat exchanger 340*f* in the mediate temperature region and is further heated once again and then transferred to the fifth heat exchanger 350*f* in the high temperature region. The working fluid which is further heated through heat exchange with the waste heat gas stream in the fourth heat exchanger 340*f* and the fifth heat exchanger 350*f* to be a fluid of high temperature and high pressure is supplied to the high-pressure turbine 430 to drive the high-pressure turbine 430.

The working fluid passed through the high-pressure turbine 430 is cooled while passing through the first recuperator 210 and the second recuperator 230 sequentially and transferred to the pump 100 again via the cooler 500.

If the temperature of the working fluid discharged from the pump 100 is higher than the temperature of the working fluid supplied to the first heat exchanger 310*f*, the working fluid is transferred directly to the second recuperator 230 instead of the first heat exchanger 310*f*. In this case, the reason why the working fluid is transferred to the second recuperator 230 is that even if the working fluid does not pass through the first heat exchanger 310, the working fluid can be sufficiently heated in the second recuperator 230. There is heat transfer between the working fluid passed through the pump 100 and the working fluid passed through the first recuperator 210 and the working fluid is introduced into the second recuperator 230, and is heated primarily. Thereafter, there is heat transfer between the working fluid and the waste heat gas stream in the sixth heat exchanger 360*f* to be heated secondarily, and then the working fluid is heated thirdly in the seventh heat exchanger 370*f* disposed in the high temperature region and transferred to the low-pressure turbine 410.

The working fluid passed through the low-pressure turbine 410 is cooled while passing through the first recuperator 210 and the second recuperator 230 sequentially and transferred to the pump 100 again via the cooler 500.

In the embodiments as described above, since temperature of the working fluid at the inlet end side of the turbine rises as the number of heat exchangers increases, driving efficiency of the turbine and overall thermal efficiency of the system are enhanced.

Embodiments of the present invention described above and illustrated in the drawing should not be construed as limiting the spirit and scope of the present invention. The scope of the present invention is limited only by the appended claims and those of ordinary skill in the art can make various modifications and changes to the present invention without departing from the technical idea of the present invention. Therefore, such modifications and changes will belong to the scope of the invention as far as they are apparent to those of ordinary skill in the art.

What is claimed is:

1. A supercritical carbon dioxide power generation system utilizing a plurality of heat sources comprising:

a pump which circulates a working fluid, a plurality of heat exchangers which heat the working fluid using an external heat source, a plurality of turbines which are driven by the working fluid heated by the plurality of heat exchangers, and a plurality of recuperators which perform heat exchange with each other to cool the working fluid passed through the plurality of turbines, the heat exchange being performed by using the working fluid passed through the plurality of turbines and the working fluid passed through the pump, wherein the plurality of heat exchangers are sequentially disposed and distributed at a high temperature region, an intermediate temperature region and a low temperature region such that one or more heat exchangers to be used for circulating a corresponding flow path of the working fluid determined depending on a temperature of the working fluid are selected from among the plurality of heat exchangers, and the high temperature region is located at an inlet into which a waste heat gas stream is introduced, and the low temperature region is located at an outlet through which the waste heat gas stream is discharged via the intermediate temperature region.

2. The supercritical carbon dioxide power generation system according to claim 1, further comprising:

a valve disposed at a rear end of the pump to select the circulating flow path of the working fluid by selectively supplying the working fluid to one or more selected from among the plurality of heat exchangers according to the temperature of the working fluid passed through the pump.

3. The supercritical carbon dioxide power generation system according to claim 1, wherein the plurality of heat exchangers comprise:

a first heat exchanger disposed in the low temperature region;

a fourth heat exchanger disposed in the intermediate temperature region; and a second heat exchanger, a third heat exchanger and a fifth heat exchanger, all of which are disposed in the high temperature region.

4. The supercritical carbon dioxide power generation system according to claim 3, wherein the third, the fifth and the second heat exchangers are sequentially disposed from the high temperature region toward the intermediate temperature region.

5. The supercritical carbon dioxide power generation system according to claim 4, wherein the working fluid is transferred to the first heat exchanger when the temperature of the working fluid passed through the pump is equal to or lower than a reference temperature, and the working fluid is transferred to the fourth heat exchanger when the temperature of the working fluid is higher than the reference temperature.

6. The supercritical carbon dioxide power generation system according to claim 5, wherein the plurality of recuperators comprise:

a first recuperator disposed between a rear end of a first turbine of the plurality of turbines and a front end of the pump; and a second recuperator disposed between a rear end of the first recuperator and the front end of the pump.

7. The supercritical carbon dioxide power generation system according to claim 6, wherein there is heat transfer between the working fluid having a temperature that is equal to or lower than the reference temperature and the waste heat gas stream in the first heat exchanger, and the working fluid is transferred to the first recuperator and absorbs heat from the working fluid passed through the first turbine, and is transferred to the second heat exchanger and there is a heat transfer between the working fluid and the waste heat gas stream.

8. The supercritical carbon dioxide power generation system according to claim 7, wherein the working fluid passed through the second heat exchanger is transferred to the third heat exchanger and there is heat transfer between the working fluid and the waste heat gas stream, and the working fluid is transferred to any one of the plurality of turbines.

9. The supercritical carbon dioxide power generation system according to claim 8, wherein the working fluid having the temperature which is higher than the reference temperature is transferred to the second recuperator and absorbs heat from the working fluid passed through the first recuperator, and is transferred to the fourth heat exchanger and there is heat transfer between the working fluid and the waste heat gas stream.

10. The supercritical carbon dioxide power generation system according to claim 9, wherein the working fluid passed through the fourth heat exchanger is transferred to the fifth heat exchanger and there is heat transfer between the working fluid and the waste heat gas stream, and the working fluid is transferred to another of the plurality of turbines.

11. The supercritical carbon dioxide power generation system according to claim 10, wherein the plurality of turbines comprise a high-pressure turbine driven by the working fluid supplied from any one of the third and the fifth heat exchangers and a low-pressure turbine driven by the working fluid supplied from another of the third and the fifth heat exchangers.

12. The supercritical carbon dioxide power generation system according to claim 11, wherein the high-pressure turbine is connected to the third heat exchanger while the low pressure turbine is connected to the fifth heat exchanger.

13. The supercritical carbon dioxide power generation system according to claim 1, wherein the inlet is an inlet end of the plurality of heat exchangers and the outlet is an outlet end of the plurality of heat exchangers.

* * * * *